United States Patent [19]

Manger

[11] Patent Number: 4,979,924

[45] Date of Patent: Dec. 25, 1990

[54] TOY KIT WITH STUFFED ANIMAL-LIKE FIGURINE HAVING A CHANGEABLE APPEARANCE

[76] Inventor: Nina Manger, 7855 Boulevard East, North Bergen, N.J. 07047

[21] Appl. No.: 360,456

[22] Filed: Jun. 2, 1989

[51] Int. Cl.[5] ..... A63H 3/16

[52] U.S. Cl. ..... 446/100; 446/901

[58] Field of Search ..... 446/97, 98, 99, 100, 446/101, 369, 385, 901

[56] References Cited

U.S. PATENT DOCUMENTS

| | | | |
|---|---|---|---|
| 1,023,401 | 4/1912 | Trowbridge | 446/369 |
| 1,535,925 | 4/1925 | Lee | 446/100 |
| 3,783,554 | 1/1974 | Shapero | 446/385 X |
| 4,122,628 | 10/1978 | Crowell et al. | 446/385 X |
| 4,208,832 | 6/1980 | Corriveau | 446/369 X |
| 4,579,537 | 4/1986 | Leahy | 446/99 X |
| 4,671,514 | 6/1987 | Wilson-Diehl | 446/901 X |
| 4,955,314 | 5/1976 | Robb | 446/385 X |

FOREIGN PATENT DOCUMENTS

| | | | |
|---|---|---|---|
| 566160 | 9/1975 | Switzerland | 446/99 |
| 2013508 | 8/1979 | United Kingdom | 446/99 |

*Primary Examiner*—Mickey Yu

*Attorney, Agent, or Firm*—Kirschstein, Ottinger, Israel & Schiffmiller

[57] ABSTRACT

The appearance of a stuffed animal is readily changed by substitution of one set of accessories for another set, each set converting the figurine to a different animal appearance.

1 Claim, 1 Drawing Sheet

TOY KIT WITH STUFFED ANIMAL-LIKE FIGURINE HAVING A CHANGEABLE APPEARANCE

BACKGROUND OF THE INVENTION

1. Field of the Invention

This invention generally relates to a figurine toy kit and, more particularly, to a stuffed animal-like figurine whose appearance is readily changeable.

2. Description of Related Art

Stuffed animals have long proven to be popular toys and companions for children. Although very satisfactory for their intended play purpose, the known stuffed animals had a shortcoming in that their appearance could not be changed. Thus, a teddy bear, for example, remained a teddy bear. As a result, the overall play value of such a stuffed toy was limited.

SUMMARY OF THE INVENTION

1. Objects of the Invention

It is a general object of this invention to increase the play value of stuffed toys.

It is another object of this invention to readily change the appearance of a stuffed toy.

A further object of this invention is to increase a child's manipulative skills by encouraging the child to position and remove different accessories on and from the toy.

Still another object of this invention is to stir a child's imagination by encouraging the child to impart different distinctive appearances for the toy.

Yet another object of this invention is to provide a uniquely styled stuffed toy with which a child can play for extended periods of time.

2. Features of the Invention

In keeping with these objects, and others which will become apparent hereinafter, one feature of this invention resides, briefly stated, in a convertible figurine toy kit comprising a sculptured, three-dimensional, stuffed figurine and a plurality of accessories, each positionable and removable from the figurine to impart different distinctive appearances thereto.

The figurine has a torso portion, a head portion connected to the torso portion, and limb portions connected to the torso portion. All of these portions are of a one-piece construction. The figurine has a fabric cover which encloses a stuffing material within the portions. The fabric cover has an outer peripheral surface and a first type of fastener over substantially the entire periphery of the fabric cover. Each accessory includes an outer surface having a second type of fastener complementary to the first fastener. In the preferred embodiment, the first and second fasteners are of the Velcro type. Preferably, the first fastener is comprised of a multitude of loops, and the second fastener is comprised of a multitude of hooks.

At least one of the accessories, and preferably a first group of accessories, is removably mounted on the cover by press-on placement at any selected area on the figurine portions, thereby imparting a distinctive appearance to the figurine. For example, the figurine may be imparted with any animal-like appearance such as a dog, lion, cat, etc.

In order to impart a different distinctive appearance to the figurine, at least another of the accessories, and preferably a second group of accessories, is removably mounted on the cover after said one accessory or said first group of accessories is peelingly removed from the selected area or areas on the figurine portions.

Thus, in accordance with this invention, a single figurine can be "dressed" by the various accessories to form many different distinctive appearances. A child need no longer be content with just a single stuffed animal, but can, instead, be given the option of creating his or her own toy companions. By encouraging the child to position and selectively remove different accessories, the child's manipulative skills are fostered and the child's imagination is stirred. The child can play with this changeable toy for extended time periods without being bored.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
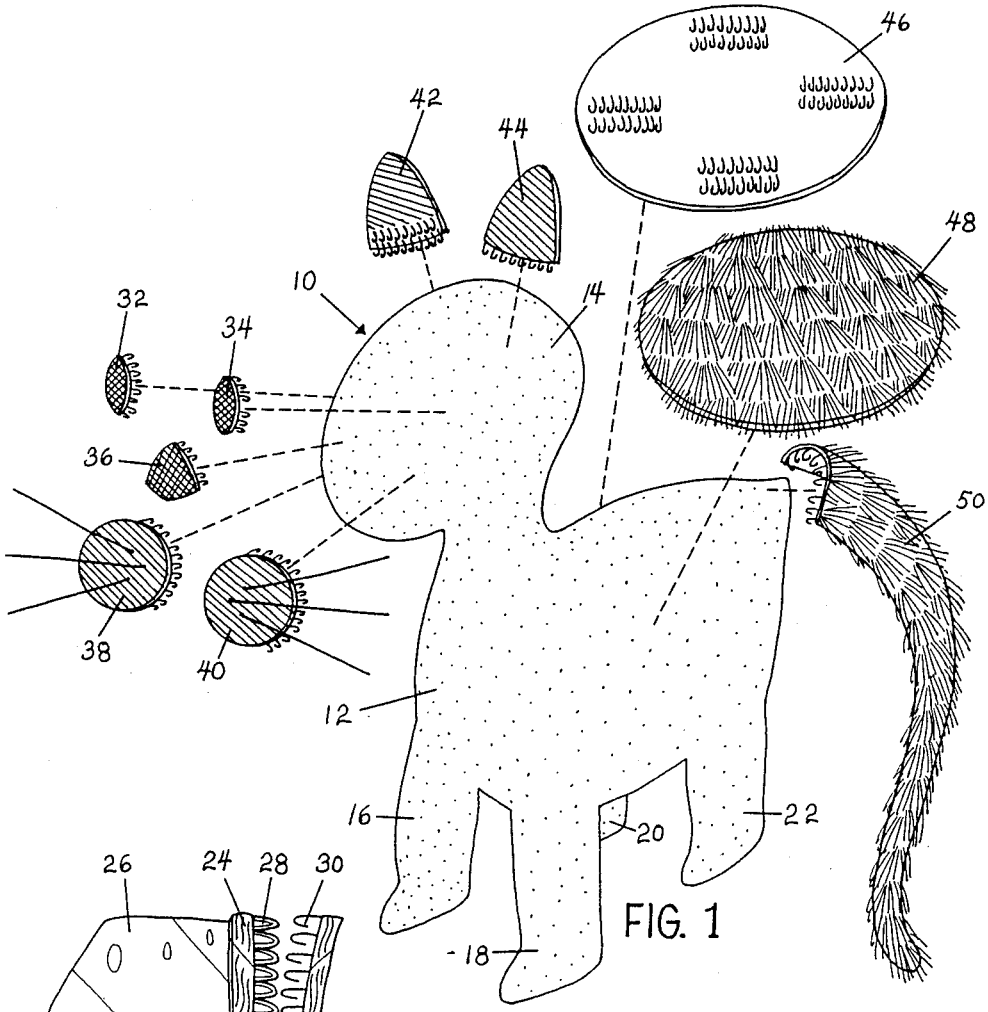
FIG. 1 is a front perspective view of a stuffed figurine together with a host of accessories to be applied thereon in accordance with this invention.

Referring now to the drawings, reference numeral 10 identifies a preferably soft, sculptured, three-dimensional, stuffed figurine having a torso portion 12, a head portion 14 connected to the torso portion, front limb portions 16, 18 connected to the torso portion, and rear limb portions 20, 22 also connected to the torso portion. All of the aforementioned portions are of a one-piece construction.

Figure 2:
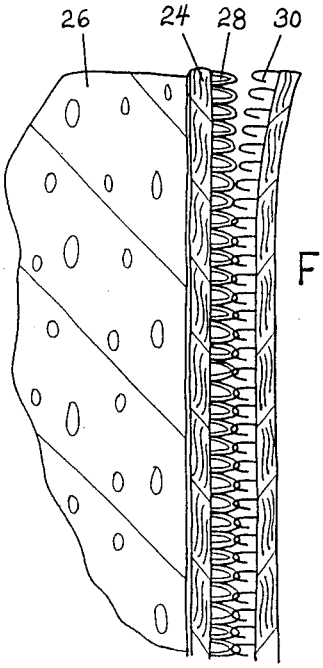
FIG. 2 is an enlarged, partly broken-away, sectional view showing the detachable connection between a representative accessory and the figurine.

The figurine, as best shown in FIG. 2, has a fabric cover 24 enclosing a stuffing material 26 within the portions. The stuffing material is preferably constituted of a foam material, but may also be made of any other material conventionally used for stuffing toys. The cover 24 has an outer peripheral surface and a first type of fastener 28 located substantially over the entire periphery of the cover 24.

Figure 3:
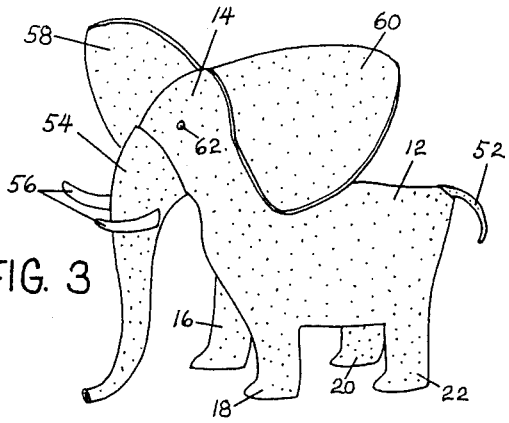
FIG. 3 is a front perspective view of a stuffed animal-like figurine with a different distinctive appearance from that shown in FIG. 1.

Thus, virtually the entire outer peripheral surface of the figurine 10 is covered by a first type of fastener which, in a preferred embodiment, is of the Velcro type and is comprised of a multitude of loops. A plurality of accessories, shown removed from the figurine in FIG. 1, and shown positioned on the figurine in FIG. 3, are each provided with an outer surface having a second type of fastener 30 which is complementary to the first fastener 28. The second fastener 30 advantageously comprises a multitude of hooks.

As shown in FIG. 1, a first group of accessories includes eye portions 32, 34, nose portion 36, cheek and whisker portions 38, 40, and ear portions 42, 44, all mounted by press-on placement at appropriate respective areas on the head portion 14. Side coat portions 46, 48 and tail portion 50, each bearing simulated fur, are mounted by press-on placement at appropriate respective areas on the torso portion 12. Thus, as indicated in FIG. 1, the aforementioned accessories 32–50, when mounted on the figurine, impart a distinctive appearance thereto; in this case, a cat.

Since each accessory has on a portion of its outer surface a multitude of hooks, each accessory is readily mountable on the cover 24 which is provided with a corresponding multitude of loops for hookingly engaging the hooks. Each accessory is peelingly removable from its selected respective area by changing the placement of the respective accessory or interchanging the respective accessory for another accessory.

Thus, another group of accessories is made available and may be provided in either the same or another kit and is mounted by press-on placement on the figurine 10 in place of the removed first group of accessories to impart a different distinctive appearance to the figurine. For example, as shown in FIG. 3, the simulated fur coat portions 46, 48 are removed and not replaced. The tail portion 50 is exchanged for a different smaller tail 52. The nose portion 36 and the cheek and whisker portions 38, 40 are exchanged for a trunk portion 54 and tusk portions 56. The ear portions 42, 44 are exchanged for larger ear portions 58, 60. The eye portions 32, 34 are exchanged for appropriate round eye portions 62, thereby changing the configuration of the figurine 10 from that of a simulated cat as shown in FIG. 1, to that of a simulated elephant as shown in FIG. 3.

Other variants are, of course, contemplated. The kit may be provided with one set of accessories or with multiple groups of accessories, each, when applied to the figurine, serving to change the appearance to that of a different animal. Additional accessories can be separately purchased. Virtually any animal or fanciful creature can be created, the only limitation being the child's imagination.

This invention is not intended to be restricted solely to animal or fanciful figurines, but, in another variant, the figurine may resemble a humanoid, in which case, the accessories would be designed with different characteristic features of different humanoids.

It will be understood that each of the elements described above, or two or more together, also may find a useful application in other types of constructions differing from the types described above.

While the invention has been illustrated and described as embodied in a toy kit with stuffed animal-like figurine having a changeable appearance, it is not intended to be limited to the details shown, since various modifications and structural changes may be made without departing in any way from the spirit or the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A toy kit convertible among different animal-like appearances, comprising:

(A) a stand-alone, three-dimensional, animal-like figurine, including (i) a body having a front and a rear spaced apart of each other along a longitudinal direction, and a top and a bottom spaced apart of each other along a height direction generally perpendicular to the longitudinal direction, (ii) a pair of front legs at the front of the body and spaced apart of each other along a transverse direction generally perpendicular to the longitudinal and height directions, said front legs extending away from the bottom of the body along the height direction, (iii) a pair of rear legs at the rear of the body and spaced apart of each other along the transverse direction, said rear legs extending away from the bottom of the body along the height direction, (iv) a head at the front of the body and extending from the top of the body along the height direction, (v) said front and rear legs together supporting the body and the head in a stable configuration resembling an animal standing on all fours, (vi) said front legs, rear legs, body and head being integrally interconnected in a unitary construction and together having a common fabric cover enclosing a common interior space in which a material is contained, said common fabric cover having an outer peripheral surface and a first type of looped fastener located over the entire periphery of the common fabric cover;

(B) a first set of accessories, each including an outer surface having a second type of hooked fastener complementary to the first looped fastener, said first set of accessories including (i) first facial feature accessories removably mounted on the head by press-on placement on a section of the cover which encloses the head, (ii) first coat accessories removably mounted on the body by press-on placement on another section of the cover, each coat accessory having an exterior covering resembling an animal exterior, (iii) a first tail accessory removably mounted on the body by press-on placement on still another section of the cover, and (iv) said first set of accessories imparting a first animal appearance to the figurine, and being peelingly removable from the figurine;

(C) a second set of accessories, each including an outer surface having the second type of hooked fastener complementary to the first looped fastener, said second set of accessories including (i) second facial feature accessories different in appearance than said first facial feature accessories and being removably mounted on the head by press-on placement on said section of the cover which encloses the head, (ii) a second tail accessory different in appearance than said first tail accessory and being removably mounted on the body by press-on placement on said still another section of the cover, and (iii) said second set of accessories imparting a second, different animal appearance to the figurine after said first set of accessories has been removed from the figurine; and (D) each set of accessories being mounted on and removed from the figurine in said stable configuration.

* * * * *